US007601229B2

(12) United States Patent
Toyoda et al.

(10) Patent No.: US 7,601,229 B2
(45) Date of Patent: Oct. 13, 2009

(54) PROCESS FOR PRODUCING SOFT MAGNETISM MATERIAL, SOFT MAGNETISM MATERIAL AND POWDER MAGNETIC CORE

(75) Inventors: Haruhisa Toyoda, Itami (JP); Hirokazu Kugai, Itami (JP); Kazuhiro Hirose, Itami (JP); Naoto Igarashi, Itami (JP); Takao Nishioka, Itami (JP)

(73) Assignee: Sumitomo Electric Industries Ltd., Osaka (JP)

( * ) Notice: Subject to any disclaimer, the term of this patent is extended or adjusted under 35 U.S.C. 154(b) by 487 days.

(21) Appl. No.: 10/595,314

(22) PCT Filed: Oct. 1, 2004

(86) PCT No.: PCT/JP2004/014477

§ 371 (c)(1),
(2), (4) Date: Apr. 7, 2006

(87) PCT Pub. No.: WO2005/038829

PCT Pub. Date: Apr. 28, 2005

(65) Prior Publication Data

US 2007/0102066 A1 May 10, 2007

(30) Foreign Application Priority Data

Oct. 15, 2003 (JP) ..... 2003-354940
Oct. 16, 2003 (JP) ..... 2003-356031
Jan. 30, 2004 (JP) ..... 2004-024256

(51) Int. Cl.
*H01F 1/20* (2006.01)
*H01F 1/24* (2006.01)

(52) U.S. Cl. ..... 148/306; 148/307; 148/309; 148/310; 148/311; 148/312; 148/313; 75/255; 428/472.3

(58) Field of Classification Search ..... None
See application file for complete search history.

(56) References Cited

U.S. PATENT DOCUMENTS 4,245,026 A * 1/1981 Ziolo ..... 430/137.1
5,925,836 A * 7/1999 Krause et al. ..... 75/246
6,309,748 B1 * 10/2001 Lashmore et al. ..... 428/403
6,702,870 B2 * 3/2004 Hultman et al. ..... 75/252

(Continued)

FOREIGN PATENT DOCUMENTS

JP 11-354359 A 12/1999

(Continued)

OTHER PUBLICATIONS

PCT International Preliminary Report on Patentability issued on Jun. 20, 2006.

*Primary Examiner*—John P. Sheehan
(74) *Attorney, Agent, or Firm*—Darby & Darby PC

(57) ABSTRACT

A method for making soft magnetic material includes: a first heat treatment step applying a temperature of at least 400 deg C. and less than 900 deg C. to metal magnetic particles; a step for forming a plurality of compound magnetic particles in which said metal magnetic particles are surrounded by insulation film; and a step for forming a shaped body by compacting a plurality of compound magnetic particles. This provides a method for making soft magnetic material that provides desired magnetic properties.

5 Claims, 2 Drawing Sheets

U.S. PATENT DOCUMENTS

2005/0162034 A1* 7/2005 Soghomonian ..... 310/216

FOREIGN PATENT DOCUMENTS

JP 2001-135515 A 5/2001
JP 2002-064011 A 2/2002
JP 2002-246219 A 8/2002
JP 2003-109810 A 4/2003
JP 2003-257723 A 9/2003

* cited by examiner

PROCESS FOR PRODUCING SOFT MAGNETISM MATERIAL, SOFT MAGNETISM MATERIAL AND POWDER MAGNETIC CORE

CROSS-REFERENCE TO PRIOR APPLICATION

This is a U.S. National Phase Application under 35 U.S.C. §371 of International Patent Application No. PCT/JP2004/014477 filed on Oct. 1, 2004. The International Application was published in Japanese on Apr. 28, 2005 as WO 2005/038829 A1 under PCT Article 21(2). All applications are incorporated herein by reference.

TECHNICAL FIELD

The present invention relates to a soft magnetic material, a method for making the same, and a dust core. More specifically, the present invention relates to: a method for making a soft magnetic material using compound magnetic particles formed from metal magnetic particles and insulation coating covering the metal magnetic particles; a soft magnetic material formed from metal magnetic particles; and a dust core formed using this soft magnetic material.

BACKGROUND ART

In electrical parts such as motor cores and transformer cores, efforts have been made to increase density and to make the design more compact. There has been a demand for parts that provide more precise control at low power. As a result, there has been on-going development in soft magnetic materials used in these electrical parts, especially in materials with superior magnetic properties in medium- and high-frequency ranges.

For example, Japanese Laid-Open Patent Publication Number 2002-246219 presents a dust core and method for making the same that allows magnetic properties to be maintained even under high-temperature environments (Patent Document 1). In the method for making a dust core described in Patent Document 1, a predetermined amount of polyphenylene sulfide (PPS resin) is mixed with an atomized iron powder coated with phosphoric acid, and this is then compressed. The obtained shape body is heated in the open air for 1 hour at 320 deg C., and then for 1 hour at 240 deg C. The structure is then cooled to form the dust core.

[Patent Document 1] Japanese Laid-Open Patent Publication Number 2002-246219

DISCLOSURE OF INVENTION

If a large number of distortions (dislocations, defects) are present in this dust core, these distortions can obstruct domain wall displacement (magnetic flux change), leading to reduced permeability of the dust core. With the dust core described in the Patent Document 1, even two heat treatments performed on the shaped body do not adequately eliminate distortions inside the structure. Thus, although there are variations depending on the frequency and PPS resin content, the effective permeability of the resulting core stays at a low value of no more than 400.

Increasing the heat treatment applied to the shaped body may be one way to adequately reduce distortions inside the dust core. However, the phosphoric acid compound covering the atomized iron particles does not have high heat resistance, leading it to degrade under heat treatment at high temperatures. This results in increased eddy current loss between the atomized iron particles covered with phosphoric acid, and this may lead to reduced permeability in the dust core.

The object of the present invention is to overcome the problems described above and to provide a soft magnetic material with desired magnetic properties, a method for making the same, and a dust core.

A method for making soft magnetic material includes: a first heat treatment step applying a temperature of at least 400 deg C. and less than 900 deg C. to metal magnetic particles; a step for forming a plurality of compound magnetic particles in which said metal magnetic particles are surrounded by insulation film; and a step for forming a shaped body by compacting a plurality of compound magnetic particles.

With this method for making soft magnetic material, the first heat treatment performed on the metal magnetic particles reduces distortions (dislocations, defects) in the metal magnetic particles ahead of time. The advantages from the first heat treatment are sufficiently obtained when the heat treatment temperature is at least 400 deg C. If the heat temperature is less than 900 deg C., the metal magnetic powders are prevented from being sintered and solidifying. If the metal magnetic powders are sintered, the solidified metal magnetic particles must be mechanically broken up, possibly leading to new distortions in the metal magnetic particles. By setting the heat treatment temperature to less than 900 deg C., this type of problem can be avoided.

By performing the first heat treatment, almost all distortions present in the shaped body become products of the compaction operation. Thus, distortions can be reduced compared to when the first heat treatment is not performed. As a result, desired magnetic properties with increased permeability and reduced coercivity can be provided. Also, since distortions in the metal magnetic particles are reduced, the compound magnetic particles are made more easy to deform during compaction. As a result, the shaped body can be formed with the multiple compound magnetic particles meshed against each other with no gaps, thus increasing the density of the shaped body.

It is preferable for the first heat treatment step to include a step for heat treating the metal magnetic particles at a temperature of at least 700 deg C. and less than 900 deg C. With this method for making soft magnetic material, the first heat treatment can further reduce distortions present in the metal magnetic particles.

It is preferable to further include a second heat treatment step applying a temperature of at least 200 deg C. and no more than a thermal decomposition temperature of the insulation film to the shaped body. With this method for making soft magnetic material, the second heat treatment can further reduce distortions present in the metal magnetic particles. Since the distortions in the metal magnetic particles have already been reduced ahead of time, almost all the distortions in the shaped body are the result of pressure applied in a single direction to the compound magnetic particles during compaction. Thus, the distortions in the shaped body exist without complex interactions with each other.

For these reasons, distortions in the shaped body can be adequately reduced even with a relatively low temperature that is no more than the thermal decomposition temperature of the insulation film, e.g., no more than 500 deg C. in the case of a phosphoric acid based insulation film. Also, since the temperature of the heat treatment is no more than the thermal decomposition temperature of the insulation film, there is no deterioration of the insulation film surrounding the metal magnetic particles. As a result, inter-particle eddy current loss generated between the compound magnetic particles can be reliably reduced. Also, by setting the heat treatment temperature to be at least 200 deg C., the advantages of the second heat treatment can be adequately obtained.

It is preferable for the step for forming the shaped body to include a step for forming the shaped body in which the plurality of compound magnetic particles is bonded by organic matter. With this method for making soft magnetic material, organic matter is interposed between the compound magnetic particles. Since the organic matter acts as a lubricant during compaction, destruction of the insulation film can be prevented.

It is preferable for the first heat treatment step to include a step for setting a coercivity of the metal magnetic particles to be no more than $2.0\times10^2$ A/m. With this method for making soft magnetic material, the first heat treatment operation reduces the coercivity of the metal magnetic particles to no more than $2.0\times10^2$ A/m, thus further improving the increase in permeability and the reduction in coercivity of the shaped body.

It is more preferable for the first heat treatment step to include a step for setting a coercivity of the metal magnetic particles to be no more than $1.2\times10^2$ A/m.

It is preferable for the first heat treatment step to include a step for heat treating the metal magnetic particle having a particle diameter distribution that is essentially solely in a range of at least 38 microns and less than 355 microns. With this method for making soft magnetic material, the particle diameter distribution of the metal magnetic particles can be set to at least 38 microns so that the influence of "stress-strain due to surface energy" can be limited. This "stress-strain due to surface energy" refers to the stress-strain generated due to deformations and defects present on the surface of the metal magnetic particles, and its presence can obstruct domain wall displacement. By limiting this influence, the coercivity of the shaped body can be reduced and iron loss resulting from hysteresis loss can be reduced. Also, by having the particle diameter distribution at least 38 microns, the drawing together of metal magnetic particles in clumps can be prevented. Also, by having the particle diameter distribution at less than 355 microns, it is possible to reduce eddy current loss within the metal magnetic particles. As a result, iron loss in the shaped body caused by eddy current loss can be reduced.

It is more preferable for the first heat treatment step to include a step for heat treating the metal magnetic particle having a particle diameter distribution that is essentially solely in a range of at least 75 microns and less than 355 microns. By further removing metal magnetic particles having particle diameters or at least 38 microns and less than 75 microns, it is possible to further reduce the proportion of the particles affected by the "stress-strain due to surface energy", thus making it possible to reduce coercivity.

A soft magnetic material according to the present invention includes multiple metal magnetic particles. The metal magnetic particles have a coercivity of no more than $2.0\times10^2$ A/m and the metal magnetic particles have a particle diameter distribution that is essentially solely in a range of at least 38 microns and less than 355 microns.

With this method for making soft magnetic material, the metal magnetic particles serving as the raw material for the shaped body have a low coercivity of $2.0\times10^2$ A/m. Also, since the metal magnetic particles have a particle diameter distribution that is essentially solely in a range of at least 38 microns and less than 355 microns, the influence of "stress-strain due to surface energy" can be limited, and the eddy current loss within the metal magnetic particles can be reduced. Thus, when a shaped body is made using the soft magnetic material of the present invention, both hysteresis loss and eddy current loss are reduced, resulting in reduced iron loss in the shaped body.

It is more preferable for the metal magnetic particles to have a coercivity of no more than $1.2\times10^2$ A/m. It is more preferable for the metal magnetic particles to have a particle diameter distribution that is essentially solely in a range of at least 75 microns and less than 355 microns.

The soft magnetic material includes a plurality of compound magnetic particles containing the metal magnetic particles and insulation film surrounding surfaces of the metal magnetic particles. With this soft magnetic material, the use of the insulation film makes it possible to limit eddy current flow between metal magnetic particles. This makes it possible to reduce iron loss resulting from eddy currents between particles.

The coercivity of a dust core made using any of the soft magnetic materials described above is no more than $1.2\times10^2$ A/m. With this dust core, the coercivity of the dust core is adequately low so that hysteresis loss can be reduced. As a result, a dust core with soft magnetic material can be used even in low-frequency ranges, where the proportion of hysteresis loss in iron loss is high.

As described above, the present invention provides a soft magnetic material, a method for making the same, and a dust core that provides desired magnetic properties.

DETAILED DESCRIPTION OF THE INVENTION

The embodiments of the present invention will be described, with references to the drawings.

Figure 1:
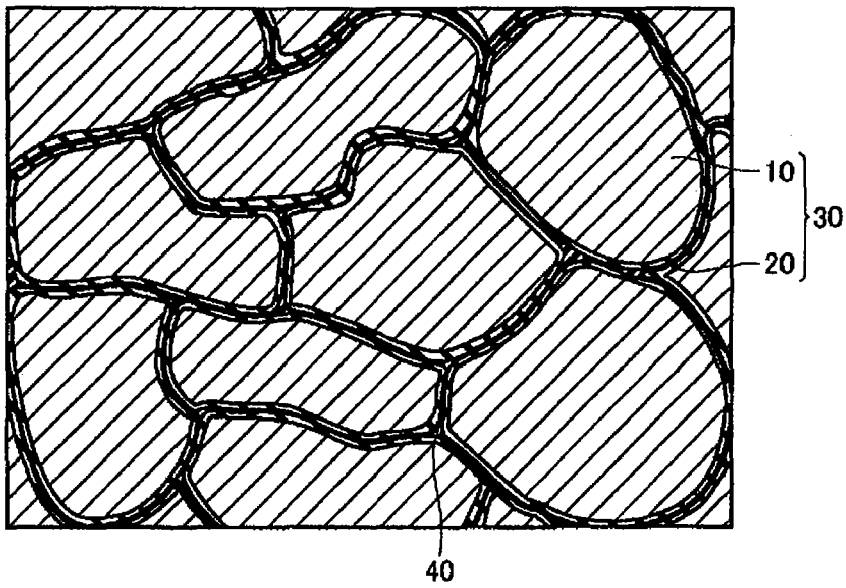
FIG. 1 is a simplified detail drawing of a shaped body made using a method for making a soft magnetic material according to a first embodiment of the present invention.

As shown in FIG. 1, a shaped body is formed from: multiple compound magnetic particles 30 formed a metal magnetic particle 10 and an insulation film 20 surrounding the surface of the metal magnetic particle 10; and an organic matter 40 interposed between the compound magnetic particles 30. The compound magnetic particles 30 are bonded to each other by the organic matter 40 or by the engagement of the projections and indentations of the compound magnetic particles 30.

The shaped body in FIG. 1 is made by first preparing the metal magnetic particles 10. The metal magnetic particle 10 can be formed from, e.g., iron (Fe), an iron (Fe)-silicon (Si)-based alloy, an iron (Fe)-nitrogen (N)-based alloy, an iron (Fe)-nickel (Ni)-based alloy, an iron (Fe)-carbon (C)-based alloy, an iron (Fe)-boron (B)-based alloy, an iron (Fe)-cobalt (Co)-based alloy, an iron (Fe)-phosphorous (P)-based alloy, an iron (Fe)-nickel (Ni)-cobalt (Co)-based alloy, or an iron (Fe)-aluminum (Al)-Silicon (Si)-based alloy. The metal magnetic particle 10 can be a single metal or an alloy.

It is preferable for the mean particle diameter of the metal magnetic particle 10 to be at least 5 microns and no more than 300 microns. With a mean particle diameter of at least 5 microns for the metal magnetic particle 10, oxidation of the metal becomes more difficult, thus improving the magnetic properties of the soft magnetic material. With a mean particle diameter of no more than 300 microns for the metal magnetic particle 10, the compressibility of the mixed powder is not reduced during the pressurized compacting operation, described later. This provides a high density for the shaped body obtained from the pressurized compacting operation.

The mean particle diameter referred to here indicates a 50% particle diameter D, i.e., with a particle diameter histogram measured using the sieve method, the particle diameter of particles starting from the lower end of the histogram that have a mass that is 50% of the total mass.

It is preferable for the particle diameters of the metal magnetic particles 10 to be effectively distributed solely in the range of at least 38 microns and less than 355 microns. In this case, metal magnetic particles 10 from which particles with particle diameters of less than 38 microns and particles diameters of at least 355 microns have been forcibly excluded are used. It is more preferable for the particle diameters of the metal magnetic particles 10 to be effectively distributed solely in the range of at least 75 microns and less than 355 microns.

Next, heat treatment with a temperature of at least 400 deg C. and less than 900 deg C. is applied to the metal magnetic particles 10. It is preferable for the heat treatment temperature to be at least 700 deg C. and less than 900 deg C. Before heat treatment, there are a large number of distortions (dislocations, defects) inside the metal magnetic particles 10. Applying heat treatment on the metal magnetic particles 10 makes it possible to reduce these distortions.

This heat treatment is performed so that the coercivity of the metal magnetic particle 10 is no more than $2.0\times10^2$ A/m (~2.5 oersteds), or, more preferably, no more than $1.2\times10^2$ A/m (=1.5 oersteds). More specifically, the more the heat treatment temperature in the above range approaches 900 deg C., the greater the reduction in coercivity of the metal magnetic particle 10 is.

Next, the compound magnetic particles 30 is made by forming the insulation film 20 on the metal magnetic particle 10. The insulation film 20 can be formed by treating the metal magnetic particle 10 with phosphoric acid.

It is also possible to form the insulation film 20 so that it contains an oxide. Examples of the insulation film 20 containing an oxide include oxide insulators such as: iron phosphate containing phosphorous and iron; manganese phosphate; zinc phosphate; calcium phosphate; aluminum phosphate; silicon oxide; titanium oxide; aluminum oxide; and zirconium oxide.

The insulation film 20 serves as an insulation layer between the metal magnetic particles 10. Coating the metal magnetic particle 10 with the insulation film 20 makes it possible to increase the electrical resistivity p of the soft magnetic material. As a result, the flow of eddy currents between the metal magnetic particles 10 can be prevented and iron loss in the soft magnetic material resulting from eddy currents can be reduced.

It is preferable for the thickness of the insulation film 20 to be at least 0.005 microns and no more than 20 microns. By setting the thickness of the insulation film 20 to be at least 0.005 microns, it is possible to efficiently limit energy loss resulting from eddy currents. Also, setting the thickness of the insulation film 20 to be no more than 20 microns, prevents the proportion of the insulation film 20 in the soft magnetic material from being too high. As a result, significant reduction in the magnetic flux density of the soft magnetic material can be prevented.

Next, a mixed powder is obtained by mixing the compound magnetic particles 30 and the organic matter 40. There are no special restrictions on the mixing method. Examples of methods that can be used include: mechanical alloying, a vibrating ball mill, a planetary ball mill, mechano-fusion, coprecipitation, chemical vapor deposition (CVD), physical vapor deposition (PVD), plating, sputtering, vaporization, and a sol-gel method.

Examples of materials that can be used for the organic matter 40 include: a thermoplastic resin such as thermoplastic polyimide, a thermoplastic polyamide, a thermoplastic polyamide-imide, polyphenylene sulfide, polyamide-imide, polyether sulfone, polyether imide, or polyether ether ketone; a non-thermoplastic resin such as high molecular weight polyethylene, wholly aromatic polyester, or wholly aromatic polyimide; and higher fatty acid based materials such as zinc stearate, lithium stearate, calcium stearate, lithium palmitate, calcium palmitate, lithium oleate, and calcium oleate. Mixtures of these can be used as well.

It is preferable for the proportion of the organic matter 40 relative to the soft magnetic material to be more than 0 and no more than 1.0 percent by mass. By setting the proportion of the organic matter 40 to be no more than 1.0 percent by mass, the proportion of the metal magnetic particle 10 in the soft magnetic material can be kept at least a fixed value. This makes it possible to obtain a soft magnetic material with a higher magnetic flux density.

Next, the resulting mixed powder is placed in a die and compacted at a pressure of, e.g., 700 MPa-1500 MPa. This compacts the mixed powder and provides a shaped body. It is preferable for the compacting to be performed in an inert gas atmosphere or a decompression atmosphere. This prevents the mixed powder from being oxidized by the oxygen in the air.

When compacting, the organic matter 40 serves as a buffer between the compound magnetic particles 30. This prevents the insulation films 20 from being destroyed by the contact between the compound magnetic particles 30.

Next, the shaped body obtained by compacting is heat treated at a temperature of at least 200 deg C. and no more than the thermal decomposition temperature of the insulation film 20. In the case of a phosphoric acid based insulation film, for example, the thermal decomposition temperature of the insulation film 20 is 500 deg C. This heat treatment is performed in order to reduce distortions formed inside the shaped body during the compacting operation.

Since the distortions originally present in the metal magnetic particles 10 have already been removed by the heat treatment performed on the metal magnetic particles 10, there are relatively few distortions in the shaped body after compaction. Also, there are no complex interactions between distortions created by the compaction operation and distortions that were already present in the metal magnetic particles 10. Furthermore, new distortions are formed by the application of pressure from one direction to the mixed powder housed in the die. For these reasons, distortions in the shaped body can be easily reduced even though heat treatment is performed with a relatively low temperature, i.e., a temperature no more than the thermal decomposition temperature of the insulation film 20.

Also, since there are almost no distortions in the metal magnetic particle 10, the compound magnetic particles 30 tends to easily deform during compaction. As a result, the shaped body can be formed with no gaps between the interlocking compound magnetic particles 30 as shown in FIG. 1. This makes it possible to provide a high density for the shaped body and high magnetic permeability.

Also, since heat treatment is performed on the shaped body at a relatively low temperature, the insulation film 20 does not deteriorate. As a result, the insulation films 20 cover the metal magnetic particles 10 even after heat treatment, and the insulation films 20 reliably limit the flow of eddy currents between the metal magnetic particles 10. It is more preferable for the shaped body obtained by compaction to be heat treated at a temperature of at least 200 deg C. and no more than 300 deg C. This makes it possible to further limit deterioration of the insulation film 20.

The shaped body shown in FIG. 1 is completed by following the steps described above. In the present invention, the mixing of the organic matter 40 into the compound magnetic particles 30 is not a required step. It is also possible to not mix the organic matter 40 and perform compaction on just the compound magnetic particles 30.

A method for making a soft magnetic material according to an embodiment of the present invention includes: a first heat treatment step heating the metal magnetic particles 10 at a temperature of at least 400 deg C. and less than 900 deg C.; a step for forming multiple compound magnetic particles 30 in which the metal magnetic particle 10 is surrounded by the insulation film 20; a step for forming a shaped body by compacting the multiple compound magnetic particles 30. The method for making the soft magnetic material further includes a second heat treatment step performed on the shaped body at a temperature of at least 200 deg C. and no more than the temperature of thermal decomposition of the insulation film 20.

According to another aspect, a method for making a soft magnetic material includes: a first heat treatment step applied to multiple metal magnetic particles 10 at a temperature of at least 400 deg C. and less than 900 deg C.; and a step for forming a shaped body by compacting the multiple metal magnetic particles 10.

With this method of making soft magnetic material, heat treatment is performed on the metal magnetic particles 10 at a predetermined temperature range before the metal magnetic particles 10 are coated with the insulation film 20. This heat treatment operation is preferable because it allows the shaped body to be formed with low distortion while not resulting in deterioration of the insulation film 20. Also, by performing further heat treatment to the shaped body, distortion in the shaped body can be further reduced. As a result, desired magnetic properties with increased permeability and reduced coercivity can be provided.

In a soft magnetic material according to another embodiment of the present invention, the metal magnetic particles 10 are obtained through the method for making soft magnetic material described above with heat treatment performed at a temperature of at least 400 deg C. and less than 900 deg C. In this embodiment, the coercivity of the metal magnetic particle 10 is no more than $2.0\times10^2$ A/m (=2.5 oersteds). Also, the particle diameters of the metal magnetic particles 10 have an effective distribution solely in the range of at least 38 microns and less than 355 microns. By using the metal magnetic particles 10, which have adequately low coercivity and with the particle diameter distribution adjusted to fall in a predetermined range, it is possible to form a shaped body with a coercivity of no more than $1.2\times10^2$ A/m (=1.5 oersteds).

The soft magnetic material and method for making soft magnetic material according to the present invention can be used to make products such as dust cores, choke coils, switching power supply elements, magnetic heads, various types of motor parts, automotive solenoids, various types of magnetic sensors, and various types of electromagnetic valves.

EXAMPLES

A first example described below was performed to evaluate the method of making soft magnetic material.

The shaped body shown in FIG. 1 was prepared according to the production method described previously. For the metal magnetic particle 10, iron powder from Hoganas Corp. (product name ASC 100.29) was used. Heat treatment was performed on the metal magnetic particles 10 at various temperature conditions from 100 deg C. to 1000 deg C. Heat treatment was performed for 1 hour in hydrogen or inert gas. When the coercivity of the metal magnetic particle 10 was measured after heat treatment, values of less than 2.5 oersteds were found. Next, a phosphate film was coated over the metal magnetic particle 10 to serve as the insulation film 20 to form the compound magnetic particles 30. Compound magnetic particles 30 in which heat treatment was not performed on the metal magnetic particles 10 were also prepared.

In this example, the compound magnetic particles 30 was placed in a die and compacted without mixing in the organic matter 40. A pressure of 882 MPa was used. The maximum permeability and coercivity of the obtained shaped body was measured. Next, heat treatment was performed on the shaped body for 1 hour at a temperature of 300 deg C. The maximum permeability and coercivity of the shaped body was then measured again.

Table 1 shows the measured maximum permeabilities and coercivities. In Table 1, the measurements for heat treatment at 30 deg C. were performed for the metal magnetic particles 10 that did not undergo heat treatment.

TABLE 1

| Heat treatment temperature | Maximum permeability | | Coercivity (Oe) | |
|---|---|---|---|---|
| for metal magnetic particles | Shaped body before heat treatment | Shaped body after heat treatment | Shaped body before heat treatment | Shaped body after heat treatment |
| 30 | 546.7 | 650.7 | 4.85 | 2.92 |
| 100 | 549.0 | 652.9 | 4.83 | 2.91 |
| 200 | 545.6 | 651.8 | 4.86 | 2.91 |
| 300 | 567.4 | 671.7 | 4.72 | 2.90 |
| 400 | 591.5 | 736.7 | 4.55 | 2.75 |
| 500 | 642.4 | 828.6 | 4.21 | 2.52 |
| 600 | 691.5 | 920.5 | 3.93 | 2.13 |
| 700 | 705.7 | 983.4 | 3.87 | 1.99 |
| 800 | 712.8 | 998.2 | 3.85 | 1.97 |
| 850 | 720.0 | 1003.1 | 3.83 | 1.97 |
| 900 | 721.6 | 1009.8 | 3.84 | 1.98 |
| 1000 | 726.9 | 1017.9 | 3.83 | 1.96 |

Figure 2:
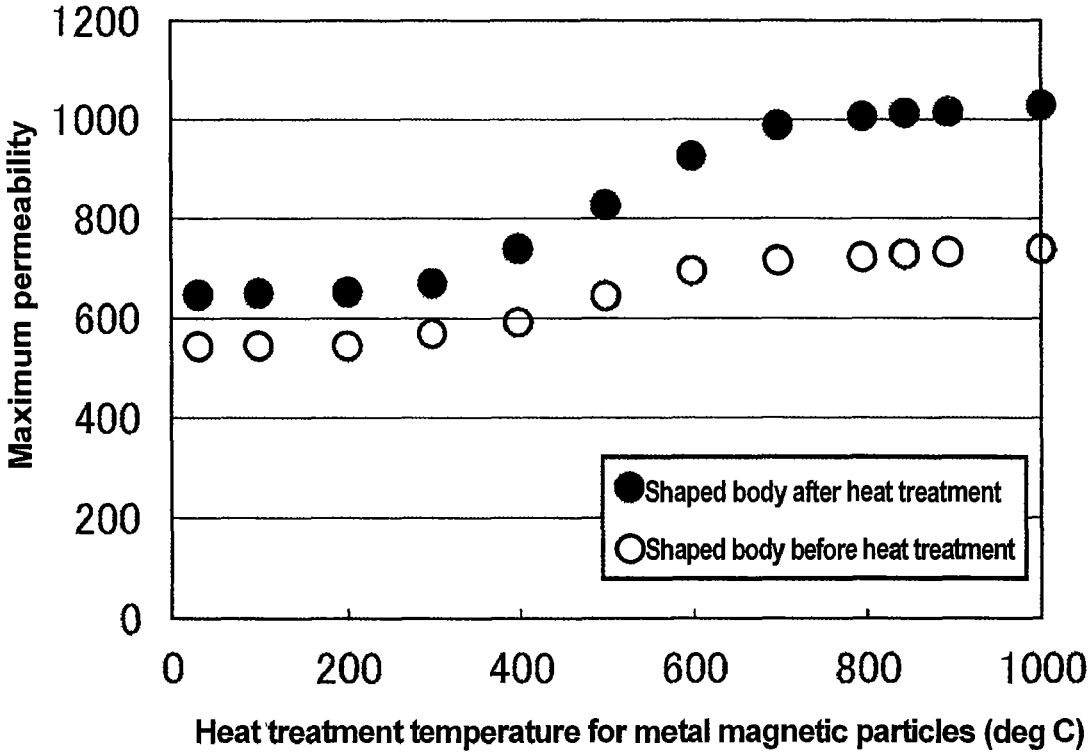
FIG. 2 is a graph showing the relationship between the temperature of heat treatment performed on the metal magnetic particles and the maximum permeability of a shaped body.
Figure 3:
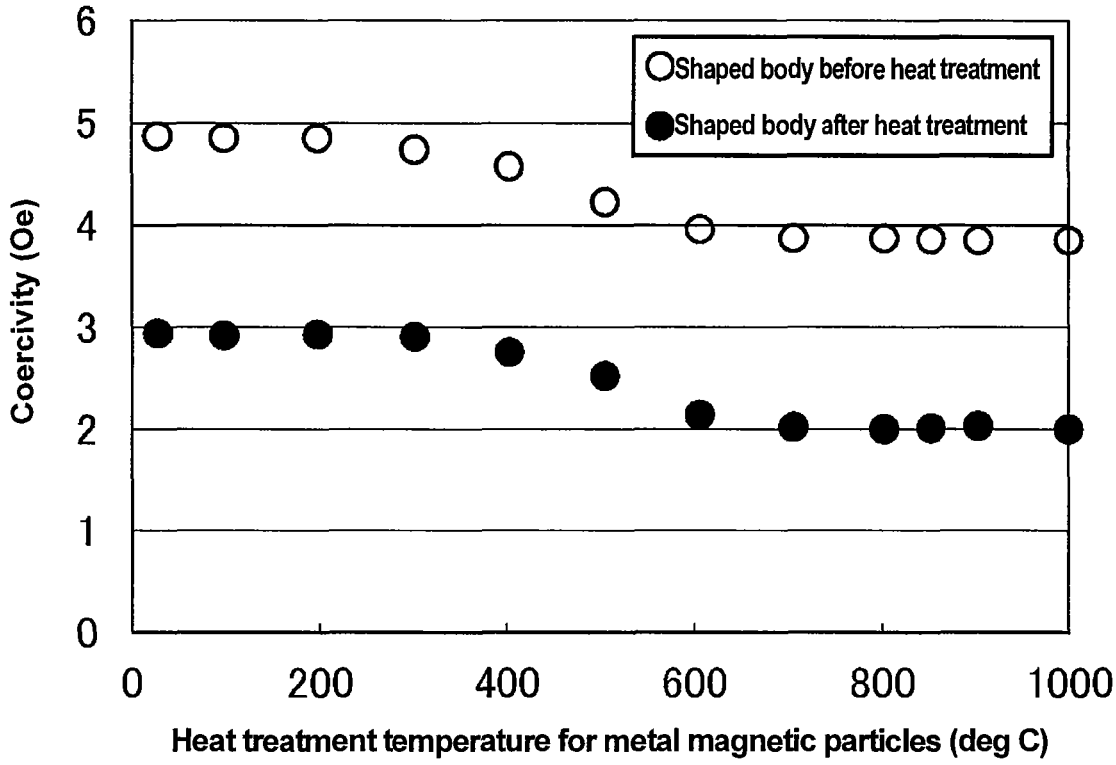
FIG. 3 is a graph showing the relationship between the temperature of heat treatment performed on the metal magnetic particles and the coercivity of a shaped body.

As can be seen from FIG. 2 and FIG. 3, applying heat treatment to the metal magnetic particles 10 at temperatures of at least 400 deg C. and less than 900 deg C. increased the maximum permeability and reduced the coercivity for the shaped body before heat treatment. In particular, advantages were more prominent for maximum permeability compared to coercivity. Also, among the measurements, maximum permeability was roughly maximum and coercivity was roughly minimum when heat treatment was performed on the metal magnetic particles 10 at temperatures of at least 700 deg C. When heat treatment was performed at temperatures of 900 deg C. and 1000 deg C., the metal magnetic particles 10 were partially sintered, preventing these sections from being used in the next step. Almost no differences were observed in maximum permeability and coercivity compared to when heat treatment was performed at a temperature of 850 deg C.

Also, by performing heat treatment on the shaped bodies at predetermined temperatures, the maximum permeability of the shaped body could be further increased and the coercivity could be further reduced. As can be seen from FIG. 2, these further increases in maximum permeability were greater when the heat treatment temperature for the metal magnetic particle 10 was higher.

Also, when the density of the shaped body for which heat treatment was not performed on the metal magnetic particles 10 and the density of shaped bodies that underwent heat treatment at least 400 deg C. and less than 900 deg C. were measured, the former shaped body was measured at 7.50 g/cm$^3$ and the latter shaped body was measured at 7.66 g/cm$^3$. As a result, it was confirmed that the density of the shaped body can be increased by applying heat treatment to the metal magnetic particles 10 at a predetermined temperature.

Next, a second example described below was prepared to evaluate the soft magnetic material according to another embodiment.

Atomized iron powder prepared through water atomizing was used as the metal magnetic particles 10. A sieve was used to sort the powder and atomized iron powder sample 1 through sample 7 having different particle diameter distributions were prepared. Heat treatment was performed on these atomized iron powders for 1 hour at a temperature of 800 deg C. in a hydrogen or an inert gas. Next, the coercivity of the heat-treated atomized iron powder was measured using the method described below.

First, a suitable amount of atomized iron powder was formed into pellets using a resin binder to serve as solid pieces to be measured. Magnetic fields of 1 (T:tesla)—>—1 T—>1 T—>-1 T were sequentially applied to the solid pieces and the resulting M(magnetization)-H(magnetic field) loop shapes were determined using vibrating sample magnetometry (VSM). The coercivity of the solid piece was calculated from the M-H loop shape, and the obtained coercivity was used as the coercivity of the atomized iron powder. Measurement results are shown in Table 2 along with the particle diameter distribution of the atomized iron powder samples. For the purpose of comparison, Table 2 includes the particle diameter distributions and coercivities for insulation-coated iron powders from Hoganas Corp. (product names Somaloy 500 and Somaloy 550).

TABLE 2

| | Atomized iron powder | | Shaped body | |
|---|---|---|---|---|
| | Particle diameter distribution (microns) | Coercivity (Oe) | Coercivity (Oe) | Macimum permeability |
| Sample 1 | >0, <355 | 3.53 | 2.26 | 680 |
| Sample 2 | ≧38, <355 | 2.37 | 1.48 | 725 |
| Sample 3 | ≧75, <355 | 1.90 | 1.18 | 772 |
| Sample 4 | ≧106, <355 | 1.65 | 1.03 | 798 |
| Sample 5 | ≧150, <355 | 1.64 | 1.02 | 825 |
| Sample 6 | ≧180, <355 | 1.63 | 1.02 | 831 |
| Sample 7 | ≧220, <355 | 1.63 | 1.02 | 835 |
| Somaloy 500 (Hoganas Corp.) | >0, ≦150 | 3.6 | 3.0 | 600 |
| Somaloy 550 (Hoganas Corp.) | ≧106, ≦425 | 3.7 | 3.5 | 650 |

Next, a phosphate film was coated over the heat-treated atomized iron powder to serve as the insulation film 20, and the coated atomized iron powder was placed in a die and compacted. A pressure of 882 MPa was used. The obtained shaped bodies were heat treated for 1 hour at a temperature of 300 deg C. Then, the coercivity and maximum permeability of the shaped bodies were measured. Also, shaped bodies were prepared using similar steps from Hoganas Corp.'s Somaloy 500 and Somaloy 550, and the coercivity and maximum permeability of these shaped bodies were measured as well. The results from these measurements are shown in Table 2.

Referring to Table 2, a comparison of sample 1 and the samples that used Hoganas Corp.'s Somaloy 500 and Somaloy 550, where the coercivity exceeded 2.5 oersteds, with the atomized iron powder of sample 2 through sample 7, where the coercivity was no more than 2.5 oersteds and the particle diameter distribution was at least 38 microns and less than 355 microns, indicates that the use of the atomized iron powder in sample 2 through sample 7 provided reduced coercivity and increased maximum permeability for the shaped bodies. Also, it was found that the use of the atomized iron powder in sample 2 through sample 7 can keep the coercivity of the shaped body to no more than 1.5 oersteds.

The embodiments and examples described above are presented for the purpose of providing examples and should not be considered restrictive. The scope of the present invention is indicated not by the above descriptions but by the claims of the invention, and is intended to include the scope of the claims, the scope of equivalences to the claims and all modifications within this scope.

INDUSTRIAL APPLICABILITY

The present invention can be used primarily to make electrical and electronic parts formed from soft magnetic material compacts such as motor cores and transformer cores.

The invention claimed is:

1. A soft magnetic powder comprising a plurality of compound magnetic particles, the plurality of compound magnetic particles comprising a plurality of metal magnetic particles and electrically insulating film surrounding surfaces of said metal magnetic particles; wherein said metal magnetic particles are iron comprising particles; wherein said metal magnetic particles have a coercivity of no more than $2.0\times10^2$ A/m and said metal magnetic particles have a particle diameter distribution that is essentially in a range of at least 38 microns and less than 355 microns; and wherein the thickness of said insulating film is at least 0.005 microns and less than or equal to 20 microns.

2. A soft magnetic powder according to claim 1 wherein said metal magnetic particles have a coercivity of no more than $1.2\times10^2$ A/m.

3. A soft magnetic powder according to claim 1 wherein said metal magnetic particles have a particle diameter distribution that is essentially in a range of at least 75 microns and less than 355 microns.

4. A dust core made using soft magnetic powder according to claim 1 wherein coercivity is no more than $1.2\times10^2$ A/m.

5. A soft magnetic powder according to claim 1, wherein the insulator film comprises a phosphate film.

* * * * *